US009937600B2

(12) United States Patent
Miyauchi et al.

(10) Patent No.: US 9,937,600 B2
(45) Date of Patent: Apr. 10, 2018

(54) SURFACE TREATMENT APPARATUS, AND SURFACE TREATMENT METHOD

(71) Applicant: KABUSHIKI KAISHA TOSHIBA, Minato-ku (JP)

(72) Inventors: Ko Miyauchi, Fujisawa (JP); Yukihiro Ikeya, Yokohama (JP); Sadayuki Sasaki, Yokohama (JP); Yoshihide Nakamura, Yokkaichi (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 246 days.

(21) Appl. No.: 14/845,841

(22) Filed: Sep. 4, 2015

(65) Prior Publication Data

US 2016/0074984 A1 Mar. 17, 2016

(30) Foreign Application Priority Data

Sep. 12, 2014 (JP) ..... 2014-186437

(51) Int. Cl.
*B24B 7/12* (2006.01)
*B24B 51/00* (2006.01)
*B24B 27/00* (2006.01)

(52) U.S. Cl.
CPC ..... *B24B 7/12* (2013.01); *B24B 27/0069* (2013.01); *B24B 51/00* (2013.01)

(58) Field of Classification Search
CPC ..... B24B 7/12; B24B 27/0069; B24B 51/00
USPC ..... 451/11, 28, 331
See application file for complete search history.

(56) References Cited

U.S. PATENT DOCUMENTS 2,621,445 A * 12/1952 Wallace ..... B24B 7/13 134/64 R
2,948,087 A * 8/1960 Caton ..... B24B 7/12 15/77
6,086,461 A * 7/2000 Williams ..... B24B 7/12 144/3.1

(Continued)

FOREIGN PATENT DOCUMENTS

JP 60-114456 A 6/1985
JP 6-31604 A 2/1994

(Continued)

OTHER PUBLICATIONS

Office Action dated Jun. 27, 2017 in Japanese Patent Application No. 2014-186437.

*Primary Examiner* — Marc Carlson
(74) *Attorney, Agent, or Firm* — Oblon, McClelland, Maier & Neustadt, L.L.P.

(57) ABSTRACT

According to an embodiment, a surface treatment apparatus includes a surface treatment portion, a supporter, and a carrying portion. The surface treatment portion has a treatment surface. The supporter has a support surface facing a second surface opposite to the first surface of the work. A frictional coefficient of the second surface and the support surface is higher than a frictional coefficient of the first surface and the treatment surface. The carrying portion applies a load in a direction in which the support surface is relatively pressed on the treatment surface, moves the support surface in a carrying direction different from the direction of the load, and thereby moves the work in the carrying direction.

17 Claims, 3 Drawing Sheets

(56) References Cited

U.S. PATENT DOCUMENTS

| | | | | |
|---|---|---|---|---|
| 6,322,426 | B1 * | 11/2001 | Akagi | B24B 1/00 451/324 |
| 6,908,362 | B2 * | 6/2005 | Selvamanickam | B24B 7/12 451/176 |
| 7,776,793 | B2 * | 8/2010 | Watanabe | B24B 7/13 451/184 |
| 8,143,194 | B2 * | 3/2012 | Horimoto | B24B 7/13 505/230 |
| 8,148,301 | B2 * | 4/2012 | Horimoto | B24B 7/13 505/230 |
| 2001/0031614 | A1 * | 10/2001 | Morkvenas | B24B 7/12 451/270 |
| 2004/0132382 | A1 * | 7/2004 | Selvamanickam | B24B 7/12 451/28 |
| 2008/0064304 | A1 * | 3/2008 | Iga | B24B 7/12 451/57 |
| 2009/0054243 | A1 * | 2/2009 | Horie | B24B 7/13 505/410 |
| 2009/0093197 | A1 * | 4/2009 | Ernst | B24B 7/12 451/178 |

FOREIGN PATENT DOCUMENTS

| | | |
|---|---|---|
| JP | 2005-14130 A | 1/2005 |
| JP | 2008-200775 | 9/2008 |

* cited by examiner

SURFACE TREATMENT APPARATUS, AND SURFACE TREATMENT METHOD

CROSS-REFERENCE TO RELATED APPLICATION

This application is based upon and claims the benefit of priority from the prior Japanese Patent Application No. 2014-186437, filed Sep. 12, 2014 the entire contents of which are incorporated herein by reference.

FIELD

Embodiments of the present invention relate to a surface treatment apparatus and a surface treatment method to treat the surface of, for example, a work.

BACKGROUND

As a method of treating the surface of, for example, a work, there has been known a method which conducts a polishing treatment by laying a belt-shaped polishing element and the work over each other and moving the belt-shaped polishing element in a direction opposite to the traveling direction of the work. There has been known another method which conducts a polishing treatment by pressing a rotary roller-shaped polishing element in the longitudinal direction of the work having both ends that are spread out. According to these methods, the work is sent to or wound around a carrying roller or a carrying reel located upstream or downstream in a carrying direction, and is thereby carried. To carry the work, it is necessary to pull the work by a load greater than the frictional force between the work and the polishing element. The work may break due to tensile force generated in the work at this point.

DETAILED DESCRIPTION

According to an embodiment, a surface treatment apparatus includes a surface treatment portion, a supporter, and a carrying portion. The surface treatment portion has a treatment surface which faces a first surface of a work and which treats the first surface. The supporter has a support surface, the support surface facing a second surface opposite to the first surface of the work, a frictional coefficient of the second surface and the support surface being higher than a frictional coefficient of the first surface and the treatment surface. The carrying portion applies a load in a direction in which the support surface is relatively pressed on the treatment surface, moves the support surface in a carrying direction of the work different from the direction of the load, and thereby moves the work in the carrying direction.

First Embodiment

Figure 1:
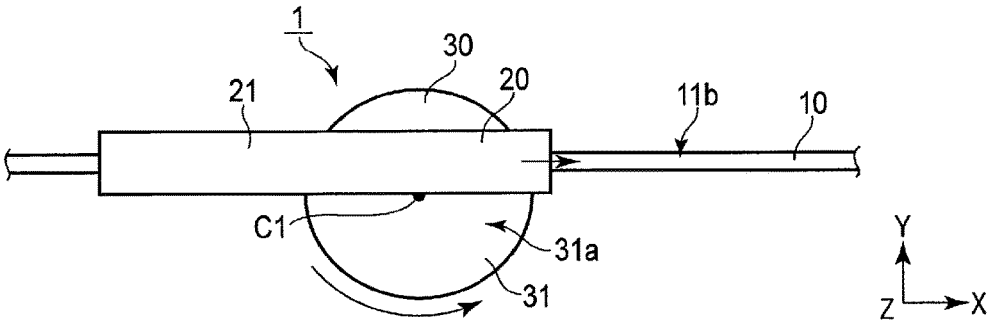
FIG. 1 is a plan view of a polishing apparatus according to a first embodiment.
Figure 2:
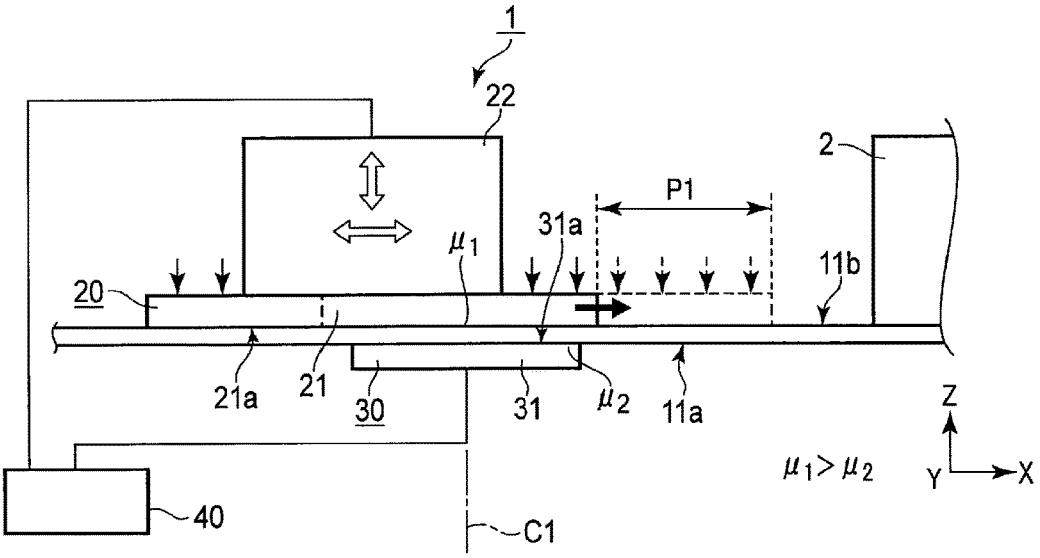
FIG. 2 is a side view of the same polishing apparatus.
Figure 3:
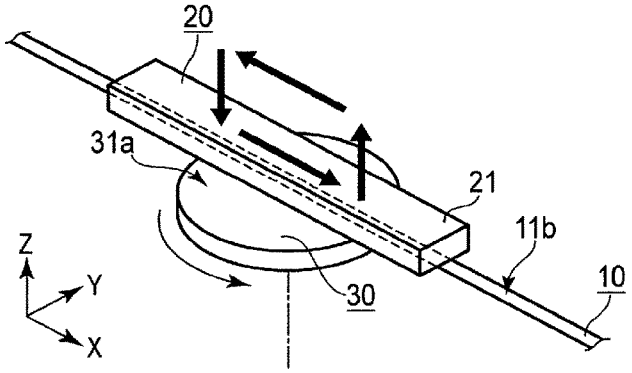
FIG. 3 is a perspective view of the same polishing apparatus.

Hereinafter, a polishing apparatus 1 according to a first embodiment of the present invention will be described with reference to FIG. 1 to FIG. 4. FIG. 1 is a plan view of the polishing apparatus 1 according to the first embodiment. FIG. 2 is a side view. FIG. 3 is a perspective view. Arrows x, y, and z in the drawings indicate three directions that intersect at right angles with one another. X extends along a carrying direction, and z extends along a pressing direction. Components shown in each of the drawings are enlarged, reduced, or omitted as appropriate for explanation. In the present embodiment, a work 10 is sheet-shaped by way of example. Specifically, a belt-shaped member is targeted for a treatment as the work 10. Moreover, in the present embodiment, the polishing apparatus 1 (surface treatment apparatus) and a polishing method (surface treatment method) to conduct a polishing treatment for polishing the surface of the work 10 by a polishing surface 31*a* are described as an example of a surface treatment.

As shown in FIG. 1 and FIG. 2, the polishing apparatus 1 comprises a polishing portion 30 having the polishing surface 31*a* which subjects a first surface 11*a* of the work 10 to a polishing treatment, a support carrying mechanism portion 20 which includes a holding table 21 as a supporter having a support surface 21*a* for supporting the work 10 and which includes a carrying portion 22 for carrying the work 10 by moving the holding table 21, and a controller 40 which controls the operations of the polishing portion 30 and the carrying portion 22. In FIG. 1 and FIG. 3, the carrying portion 22 and a post-treatment apparatus 2 are not shown.

The work 10 is a thin belt-shaped member longer in the carrying direction which is the X-direction. The work 10 is made of, for example, copper, aluminum, stainless steel, or a laminate of these materials. The work 10 is formed into, for example, a thickness of 0.1 mm to 1.0 mm which is a Z-direction dimension, and a width of 10 mm to 200 mm which is a Y-direction dimension. The work 10 is, for example, rolled and preserved before the stage of the polishing treatment. The first surface 11*a*, a second surface lib, the support surface 21*a*, and the polishing surface 31*a* constitute an XY-plane, and a rotation axis C1 is located along a Z-axis.

The polishing portion 30 which is a surface treatment portion comprises an abrasive cloth 31 which is disk-shaped and which constitutes the polishing surface 31*a* on its upper surface. The abrasive cloth 31 is made of, for example, fused alumina or silicon carbide. The polishing portion 30 is connected to the controller 40, and rotates around the axial center C1 under the control of the controller 40. The abrasive cloth 31 which constitutes the polishing surface 31*a* receives the lower surface which is the first surface 11*a* of the work 10. The abrasive cloth 31 operates in a circumferential direction different from the carrying direction when in contact with the first surface 11*a* in response to the rotation of the polishing portion 30, and thereby polishes the first surface 11*a*. At the same time, a force in a direction (e.g., lateral direction) that crosses the carrying direction is applied to the work 10 and the support surface 21*a* due to the movement in the circumferential direction.

The polishing surface 31*a* is larger than the width of the work 10 or the holding table 21, and is in a circular shape having a diameter greater than a carrying pitch P1. The work 10 is located at a position closer to one side than the axial center C1 of the polishing portion 30. The holding table 21 is oppositely located across the work 10. Thus, in response to the rotation of the polishing portion 30, the polishing surface 31*a* moves in the circumferential direction, and a force in the lateral direction (Y-direction) different from the carrying direction is applied to the work 10 and the holding table 21 that are in contact with the polishing surface 31*a*.

The support carrying mechanism portion 20 comprises the holding table 21 which receives the upper surface that is the second surface 11*b* of the work 10, and the carrying portion 22 which moves the holding table 21 to carry the work 10.

The holding table 21 is, for example, in a long rectangular plate shape longer in the carrying direction, and has the support surface 21*a* facing the polishing surface 31*a* across the work 10. In the present embodiment, the lower surface of the holding table 21 is the flat support surface 21*a*, and this support surface 21*a* receives the upper surface that is the second surface 11*b* of the work 10. Here, one side surface of the holding table 21 is set at a position that passes through the axial center C1. That is, the center of the holding table 21 is located closer to one side than the axial center C1. The support surface 21*a* faces the second surface 11*b* opposite to the first surface 11*a* of the work 10. The holding table 21 is made of, for example, stainless steel or ceramics. Its support surface 21*a*, that is, the surface which comes into contact with the belt-shaped work 10 is coated with rubber such as silicon as a treatment to increase the frictional coefficient. A frictional coefficient μ1 of the second surface lib and the support surface 21*a* is set to be higher than a frictional coefficient μ2 of the first surface 11*a* of the work 10 and the polishing surface 31*a*.

The carrying portion 22 is connected to the controller 40, and is capable of moving the holding table 21 upward and downward along the z-direction and sliding the holding table 21 back and forth along the x-direction under the control of the controller 40.

The holding table 21 comes in and out of the polishing surface 31*a* in response to the upward and downward movements. That is, the carrying portion 22 applies a load in a direction in which the holding table 21 is moved downward and the support surface 21*a* is relatively pressed on the polishing surface 31*a*. The carrying portion 22 reduces or releases this pressure force by moving the holding table 21 upward. Therefore, the pressure force can be adjusted under the control of the controller 40.

Since the frictional coefficient μ1 of the second surface 11*b* and the support surface 21*a* is set to be higher than the frictional coefficient μ2 of the first surface 11*a* of the work 10 and the polishing surface 31*a*, it is possible to carry the work 10 by combining the slide movement of the holding table 21 along the x-axis with the control of the load in the Z-axis direction.

That is, the carrying portion 22 moves the holding table 21 downward to press the holding table 21 on the polishing surface 31*a*, and slides the holding table 21 forward in the carrying direction while applying a load downward, thereby moving the work 10 facing the support surface 21*a* with greater frictional force in the carrying direction together with the movement of the support surface 21*a* in the x-direction.

As shown in FIG. 2, the post-treatment apparatus 2 which conducts a treatment after the polishing treatment is provided adjacent to the downstream side of the polishing apparatus 1 according to the present embodiment in the carrying direction. The post-treatment apparatus 2 is, for example, a thin film formation apparatus using sputtering or vapor deposition.

Figure 4:
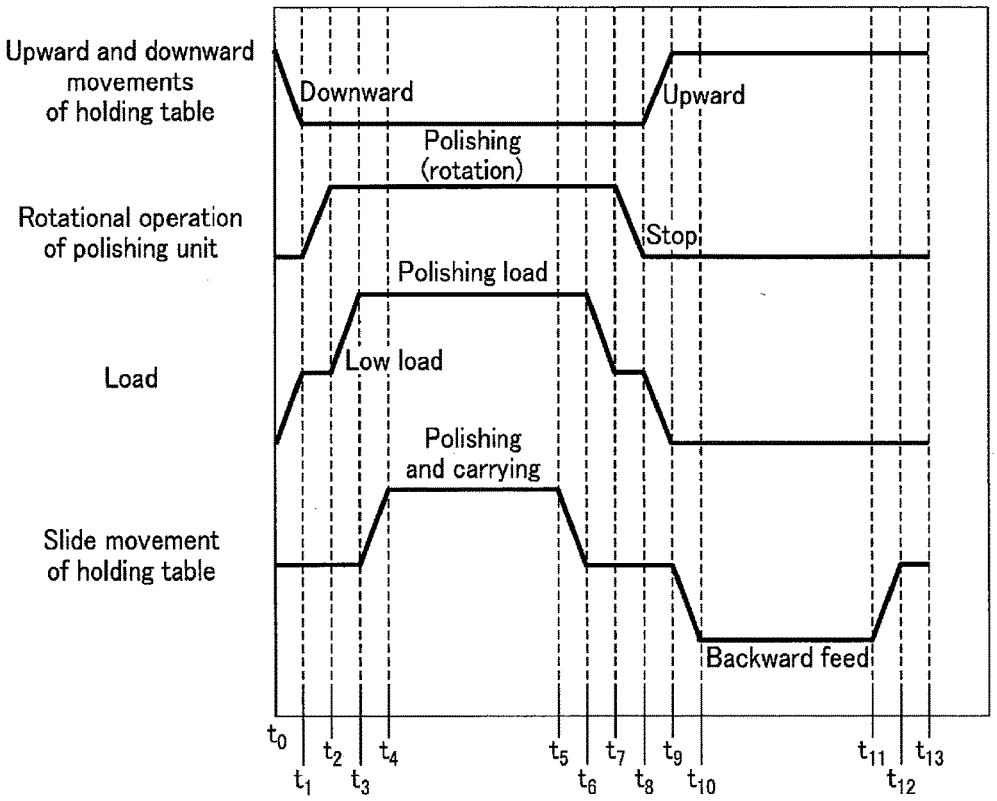
FIG. 4 is an explanatory diagram showing the operation of the same polishing apparatus.

The operation of the polishing apparatus 1 having the above configuration is described with reference to FIG. 4. FIG. 4 is an explanatory diagram showing the operation of the polishing apparatus 1, and shows a timing chart of operations: the upward and downward movements (up-down operation) of the holding table 21, the rotational operation of the polishing portion 30, the load applied to the holding table 21, and the carrying operation of the holding table 21.

When instructed to start a polishing treatment, the controller 40 first drives the carrying portion 22 to move the holding table 21 downward, brings the holding table 21 into contact with the polishing surface 31*a*, and holds with a preset first load (low load). The polishing portion 30 is then driven, and the polishing surface 31*a* is rotated. The polishing surface 31*a* rotates at a predetermined rotational velocity, so that the first surface 11*a* of the work 10 is polished. The controller 40 further increases the downward load to press the holding table 21 on the polishing surface 31*a* even after the start of the rotation. When the load has reached a second load (polishing load) greater than the first load and when the rotational velocity of the polishing portion 30 has reached a predetermined value, the controller 40 drives the carrying portion 22, and slides the holding table 21 at the predetermined carrying pitch P1 forward in the carrying direction. The carrying pitch P1 is set to a predetermined dimension smaller than the dimension of the polishing surface 31*a* in the carrying direction. At this point, the frictional coefficient μ1>μ2, so that the work 10 moves in the carrying direction at the same carrying pitch P1 in response to the movement of the holding table 21. Therefore, while the polishing treatment is being conducted, the work 10 moves in the carrying direction together with the holding table 21, and the work 10 is carried a distance of the predetermined carrying pitch P1 forward in the carrying direction.

After the end of the charring at the predetermined carrying pitch P1, the controller 40 reduces the load on the holding table 21, and stops the rotation of the polishing portion 30. After the rotation of the polishing portion 30 has stopped, the holding table 21 is lifted, and brought away from the work 10. While the holding table 21 is away, the holding table 21 is moved the predetermined carrying pitch P1 backward in the carrying direction, and the position of the holding table 21 in the x-direction is restored.

Regarding the restoring operation of the holding table 21, it is also possible to restore the holding table 21 without stopping the rotation of the abrasive cloth 31. In this case, it is necessary to apply tensile force from both sides of the work 10 in the carrying direction so that the work 10 may not be deformed when the pressure to press the first surface 11*a* of the work 10 on the abrasive cloth 31 by the holding table 21 is 0.

By repeating the above-described operations, that is, a series of operations comprising the steps of the downward movement, the start of rotation, the increase of the load, the carrying, the decrease of the load, the stopping of the rotation, the upward movement, and the restoration, it is possible to sequentially polish the belt-shaped work 10 while carrying the work 10 by the predetermined carrying pitch P1.

The following advantageous effects are obtained by the polishing apparatus 1 and the polishing method according to the embodiment. That is, no rollers and reels for applying tensile force to carry the work 10 are used, so that even if the polishing load increases, the belt-shaped work 10 can be polished without breakage. Because a mechanism to pull the work 10 is not needed, it is possible to proceed to the next process without touching the polished surface, and prevent foreign objects from adhering to the first surface 11*a* of the work from, for example, a carrying roller. For example, in the present embodiment, the thin film formation apparatus for sputtering or vapor deposition is subsequently provided, and the work 10 can move to a thin film formation process without contacting the carrying members for the polishing treatment. Therefore, the adverse effects of the foreign objects in the subsequent process can be prevented by the prevention of the adhesion of the foreign objects. Moreover, it is not necessary to provide a gripping margin for carrying, and the restrictions of the shape of the work 10 can be reduced.

The force generated laterally to the longitudinal direction of the belt-shaped work 10 by the rotating abrasive cloth 31 can be received by the holding table 21, so that the deformation of the work 10 can be prevented.

Figure 5:
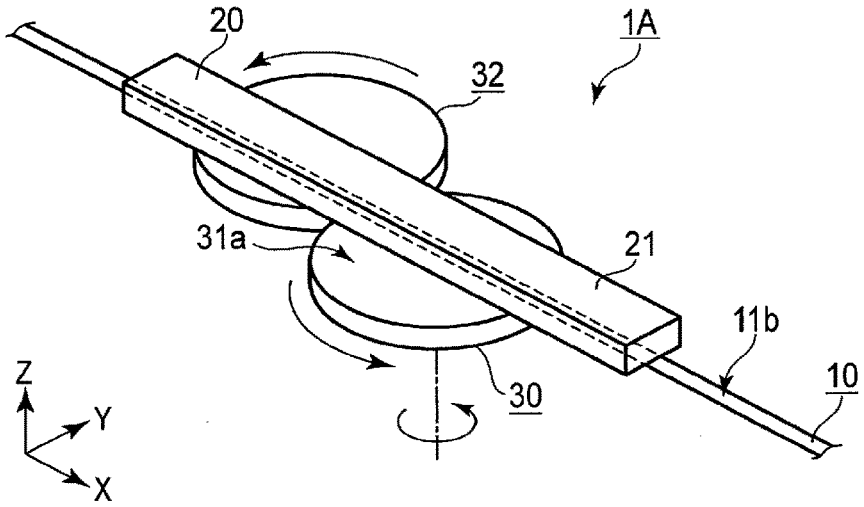
FIG. 5 is a perspective view of a polishing apparatus according to another embodiment.

The embodiment described above is illustrative only, and does not limit the scope of the invention. For example, one abrasive cloth 31 is not exclusively disposed, and more than one abrasive cloth 31 can be disposed. For example, in a polishing apparatus 1A shown in FIG. 5 as another embodiment, two abrasive cloths 31 are arranged in parallel along the carrying direction. The polishing apparatus 1A is similar in other respects to the polishing apparatus 1 according to the first embodiment described above.

Advantageous effects similar to those in the first embodiment can also be obtained by the polishing apparatus 1A and a polishing method according to the present embodiment. According to the present embodiment, more than one abrasive cloth 31*a* is arranged in parallel along the longitudinal direction of the belt-shaped work 10, so that the polishing range of the work 10 in the longitudinal direction can be extended, and the carrying pitch can also be increased.

Figure 6:
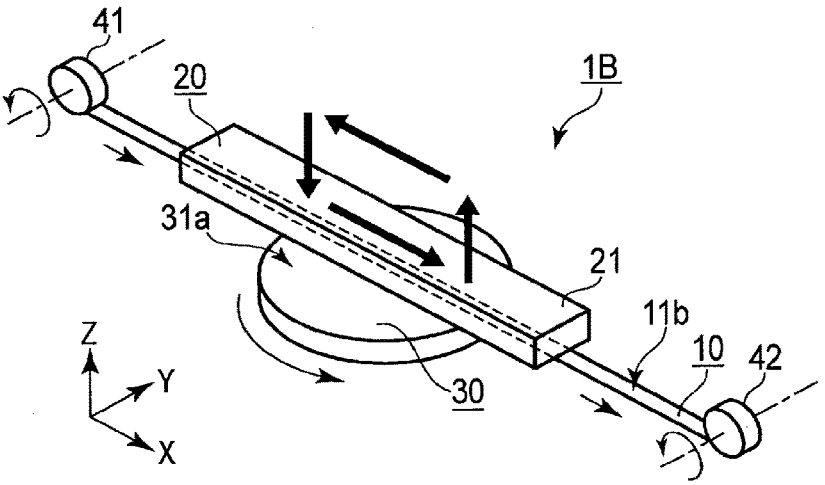
FIG. 6 is a perspective view of a polishing apparatus according to another embodiment.

Depending on the length of the belt-shaped work 10, a feed reel for supplying the belt-shaped work 10 and a winding reel for winding the belt-shaped work 10 after polished may be disposed. In a polishing apparatus 1B shown in FIG. 6 as another embodiment, a feed reel 41 is provided on the upstream side in the carrying direction of the work 10, and a winding reel 42 is provided on the downstream side in the carrying direction of the work 10. The feed reel 41 and the winding reel 42 can also be a mechanism for applying tensile force for eliminating the slack of the belt-shaped work 10 to the belt-shaped work 10. In this case as well, neither a mechanism for carrying nor tensile force for carrying is needed, and holding with low tensile force is sufficient. Therefore, in the present embodiment as well, advantageous effects similar to those in the first embodiment can also be obtained. That is, no rollers and reels for applying tensile force to carry the work 10 are used, so that even if the polishing load increases, the belt-shaped work 10 can be polished without breakage. Because the force generated laterally to the longitudinal direction of the belt-shaped work 10 by the rotating abrasive cloth 31 can be received by the holding table 21, the deformation of the work 10 can be prevented. An insertion sheet may be inserted to prevent the abrasive cloth 31*a* from being stained and damaged when the belt-shaped work 10 is wound around the winding reel.

Although the polishing apparatus 1 having the abrasive cloth 31*a* has been shown as the surface treatment apparatus by way of example, the surface treatment apparatus is not limited to the above apparatuses. For example, the present invention is also applicable to a buffing machine or a wiping cleaner as the surface treatment apparatus. In this case as well, advantageous effects similar to those in the embodiments described above can also be obtained.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A surface treatment apparatus comprising:

a surface treatment portion having a treatment surface which faces a first surface of a work and which treats the first surface;

a supporter having a support surface, the support surface facing a second surface opposite to the first surface of the work, a frictional coefficient of the second surface and the support surface being higher than a frictional coefficient of the first surface and the treatment surface;

a carrying portion which applies a load in a direction in which the support surface is relatively pressed on the treatment surface, moves the support surface in a carrying direction of the work different from the direction of the load, and thereby moves the work in the carrying direction; and a controller which controls operation of the carrying portion, wherein the controller operates the carrying portion to apply a first load in a direction in which the support surface is relatively pressed on the treatment surface, rotate the treatment surface after the application of the first load, increase a load to produce a second load greater than the first load, and apply the second load and then move the support surface in the carrying direction.

2. The surface treatment apparatus according to claim 1, wherein force is applied to the work from the surface treatment portion in a direction that crosses the carrying direction of the work.

3. The surface treatment apparatus according to claim 2, wherein the controller reduces the load after the moving, stops the rotation of the treatment surface, in a state where the load is reduced, and releases the load.

4. The surface treatment apparatus according to claim 1, wherein the work is sheet-shaped, and the treatment surface is a polishing surface which operates in a direction different from the carrying direction when in contact with the first surface and polishes the first surface.

5. The surface treatment apparatus according to claim 4, wherein the controller reduces the load after the moving, stops the rotation of the treatment surface, in a state where the load is reduced, and releases the load.

6. The surface treatment apparatus according to claim 1, wherein the controller reduces the load after the moving, stops the rotation of the treatment surface, in a state where the load is reduced, and releases the load.

7. The surface treatment apparatus according to claim 1, wherein the work is belt-shaped.

8. The surface treatment apparatus according to claim 1, wherein the controller increases a load to produce a second load greater than a first load after the rotational velocity of the treatment surface has reached a predetermined rotational velocity.

9. The surface treatment apparatus according to claim 8, wherein the controller reduces the load after the moving, stops the rotation of the treatment surface, in a state where the load is reduced, and releases the load.

10. A surface treatment method comprising:

applying, by a carrying portion, a first load in a direction in which a support surface is relatively pressed on a treatment surface;

rotating the treatment surface, in a state where the first load is applied;

increasing, by the carrying portion, a load to apply a second load greater than the first load; and moving a support portion having the support surface in a carrying direction of the work different from the direction of the load, and thereby moving the work in the carrying direction, wherein the work is provided between the treatment surface and the support surface, the treatment surface treating a first surface of the work, the support surface facing a second surface opposite to the first surface of the work, a frictional coefficient of the second surface and the support surface being higher than a frictional coefficient of the first surface of the work and the treatment surface.

11. The surface treatment method according to claim 10, wherein force is applied to the work in a direction that crosses the carrying direction of the work from the treatment surface.

12. The surface treatment method according to claim 10, wherein the treatment surface is a polishing surface which operates in a direction different from the carrying direction when in contact with the first surface and polishes the first surface.

13. The surface treatment method according to claim 10, further comprising:

reducing the load after the moving;

stopping the rotation of the treatment surface; and releasing the load after the rotation has stopped.

14. The surface treatment method according to claim 10, wherein the work is sheet-shaped.

15. The surface treatment method according to claim 10, wherein the work is belt-shaped.

16. The surface treatment method according to claim 10, further comprising:

increasing a load to produce a second load greater than a first load after the rotational velocity of the treatment surface has reached a predetermined rotational velocity.

17. The surface treatment method according to claim 16, further comprising:

reducing the load after the moving;

stopping the rotation of the treatment surface; and releasing the load after the rotation has stopped.

* * * * *